US005277628A

United States Patent [19]

Lin et al.

[11] Patent Number: 5,277,628

[45] Date of Patent: Jan. 11, 1994

[54] AUDITORY JACK

[75] Inventors: Jih-Bin Lin, Chung Ho; Kee-Haut Nyia, Taipei, all of Taiwan

[73] Assignee: Pan-International Industrial Corp., Taipei, Taiwan

[21] Appl. No.: 936,002

[22] Filed: Aug. 27, 1992

[51] Int. Cl.[5] ..... H01R 13/00

[52] U.S. Cl. ..... 439/668

[58] Field of Search ..... 439/668, 669

[56] References Cited

U.S. PATENT DOCUMENTS

| | | | |
|---|---|---|---|
| 4,978,310 | 12/1992 | Shichida | 439/668 |
| 5,092,795 | 3/1992 | Kitagawa | 439/668 |
| 5,139,444 | 8/1992 | Garay et al. | 439/668 |

*Primary Examiner*—Joseph H. McGlynn

*Attorney, Agent, or Firm*—Jacobson, Price, Holman & Stern

[57] ABSTRACT

An auditory jack includes a casing protected inside a metal shell and having an internally threaded metal socket on one end extended out of the metal shell through a hole for receiving the plug of an audio output device, an inside space divided into a plurality of troughs by a plurality of projecting blocks, into which two movable terminals and two fixed terminals are respective inserted, and a plurality of columns respectively made inside each trough and fitted into a respective round hole on a cover for permitting the cover to be firmly retained to the casing, which movable terminals each has an opposite end respectively formed into a springy triangular strip for electrically connecting the plug being threaded into said metal socket and for permitting the respective movable terminal to be able to return to a former shape after being pressed by the plug.

2 Claims, 3 Drawing Sheets

AUDITORY JACK

BACKGROUND OF THE INVENTION

The present invention relates to an auditory jack which includes a casing protected inside a metal shell and having an internally threaded metal socket extended out of the metal shell through a hole for receiving the plug of an audio output device, an inside space divided into a plurality of troughs by a plurality of projecting blocks, into which two movable terminals and two fixed terminals are respective inserted, and a plurality of columns respectively made inside each trough and fitted into a respective round hole on a cover for permitting the cover to be firmly retained to the casing, wherein the movable terminals and the fixed terminals each has an end formed into a respective angle strip inserted into a respective groove on the cover and retained in place. Threading the plug of an audio output device into the metal socket causes the movable terminals to be disconnected from the fixed terminals. The movable terminals each is respectively formed into a triangular configuration which allows the size of the jack to be greatly reduced and provides a springy material property for electrically connecting the plug being threaded into the metal socket and for permitting the respective movable terminal to be able to return to the respective former shape after being pressed by the plug. Therefore, the problem of contact failure is eliminated, and a high transmission quality is achieved.

An auditory jack is a plug-in receptacle on an audio equipment used to make electrical contact. FIG. 4 illustrates an auditory jack according to the prior art in which two contact plates (61) are fastened inside a casing (6) at two opposite locations. The contact plates (61) each has one end bent inward and a curved springy strip (62) extended from the respective middle part. The curved springy strip (62) of each contact plate (61) is connected to a respective conductor (63). The casing (6) has an externally threaded socket (64) at one end fastened with an internally threaded sleeve (65). The sleeve (65) has two opposite mounting plates (66) respectively fastened to two opposite columns (67) inside the casing (6) and two spring strips (68) separated by the mounting plates (66). As the outer connecting end (71) of the plug (7) of an audio output device is inserted through the socket (64) into the casing (6), the curved springy strip (62) of each contact plate (61) is respectively squeezed outward, and therefore the output signal of the audio equipment is sent through the curved springy strip (62) of each contact plate (61) to the audio output device through the plug (7). The main disadvantage of this structure of auditory jack is its big size. Because the curved springy strip (62) of each contact plate (61) is squeezed by the plug (7) as the plug (7) was inserted into the socket (64), the curved springy strip (62) must be made in a suitable length so that a positive contact with the plug (7) can be achieved. If the size of the curved springy strip (62) is greatly reduced, the problem of elastic fatigue may occur easily causing a contact failure.

SUMMARY OF THE INVENTION

The present invention eliminates the aforesaid problem. According to one aspect of the present invention, an auditory jack is generally comprised of a casing having an internally threaded metal socket on one end, into which the plug of an audio output device is threaded, an inside space divided into a plurality of troughs by a plurality of projecting blocks, into which two movable terminals and two fixed terminals are respective inserted, and a plurality of columns respectively made inside each trough and fitted into a respective round hole on a cover for permitting the cover to be firmly retained to the casing, wherein the movable terminals and the fixed terminals each has an end formed into a respective angle strip inserted into a respective groove on the cover and retained in place; the movable terminals each is formed into a triangular configuration which allows the size of the jack to be greatly reduced and provides a springy material property for electrically connecting the plug being threaded into the metal socket and for permitting the respective movable terminal to be able to return to the respective former shape after being pressed by the plug. Therefore, the problem of contact failure is eliminated, and a high transmission quality is achieved.

According to another aspect of the present invention, a metal shell is covered over the casing to protect against outside electromagnetic waves, and therefore the problem of audio distortion is eliminated.

DETAILED DESCRIPTION OF THE PREFERRED EMBODIMENT

Figure 1:
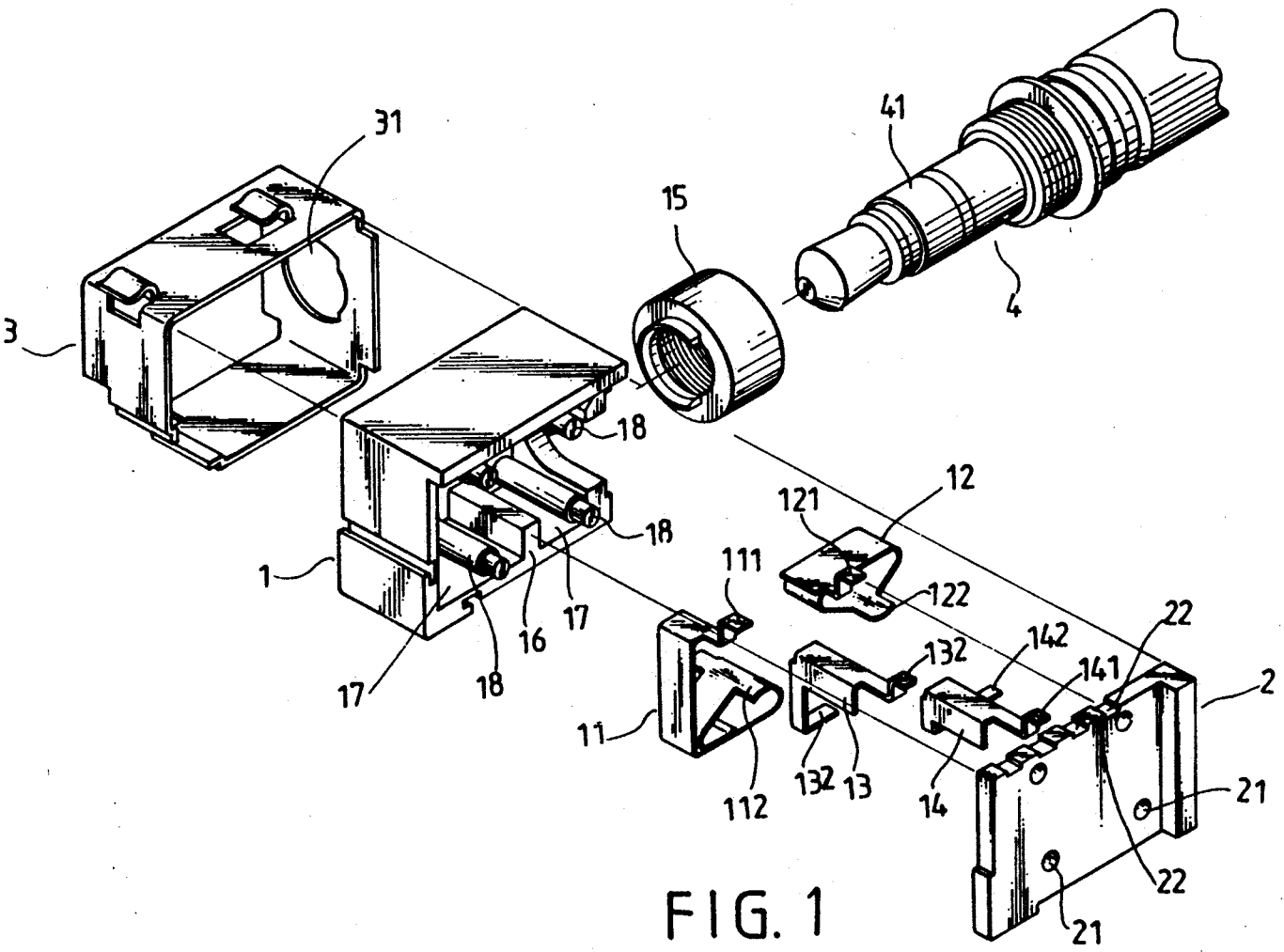
FIG. 1 is an exploded view of the preferred embodiment of the auditory jack of the present invention.

Referring to FIG. 1, an auditory jack as constructed in accordance with the present invention is generally comprised of a casing 1, a cover 2, a first movable terminal 11, a second movable terminal 12, a first fixed terminal 13, a second fixed terminal 14, an internally threaded metal socket 15, and a metal shell 3. The internally threaded metal socket 15 is fastened to the casing 1 on the outside at one end. The casing 1 has an internal space divided into a plurality of troughs 17 by a plurality of projecting blocks 16, into which the first movable terminal 11, the second movable terminal 12, the first fixed terminal 13 and the second fixed terminal 14 are respectively inserted, and a plurality of columns 18 respectively made inside each trough 17 and fitted into a respective round hole 21 on the cover 2 for permitting the cover 2 to be firmly covered on the casing 1. The first movable terminal 11, the first fixed terminal 13, the second fixed terminal 14 and the second movable terminal 12 each has one end formed into an angle strip 111, 131, 141, 121 respectively and properly inserted into grooves 22 on the peripheral edge of the cover 2 on one side. As the cover 2 was covered on the casing 1 and retained to the columns 18, the angle strip 111,131,141,121 of each terminal becomes firmly retained in place. The metal shell 3 is covered over the casing 1, having an opening 31 on one side wall thereof through which the metal socket 15 projects out of the metal shell 3.

Figure 2:
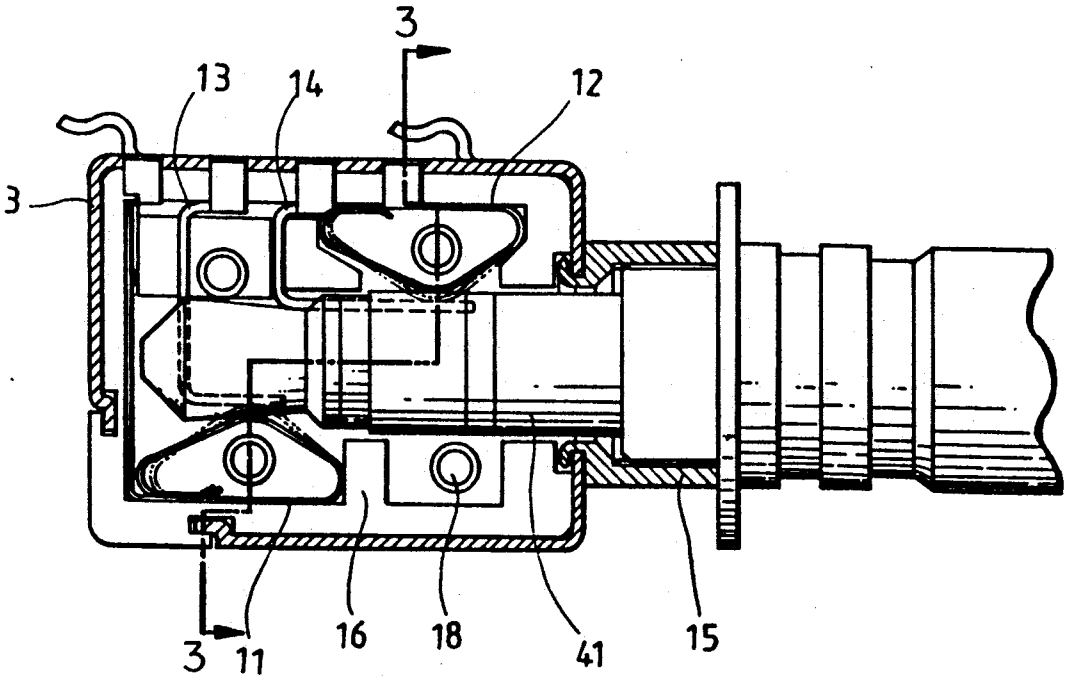
FIG. 2 is a cross section showing a plug inserted into the auditory jack of the present invention.

Referring to FIGS. 1 and 2, the first movable terminal 11 and the second movable terminal 12 each has an opposite end respectively bent inward and formed into a respective triangular strip, which has a wing portion 112 or 122 bilaterally and horizontally extended outward. The wing portion 112 or 122 of the first or second movable terminal 11 or 12 is respectively and electrically connected to a respective contact strip 132 or 142 on either fixed terminal 13 or 14. The angle strip 111 of the first movable terminal 11 and the angle strip 121 of the second movable terminal 12 are respectively extended out of the cover 2 through the respective grooves 22.

Figure 3:
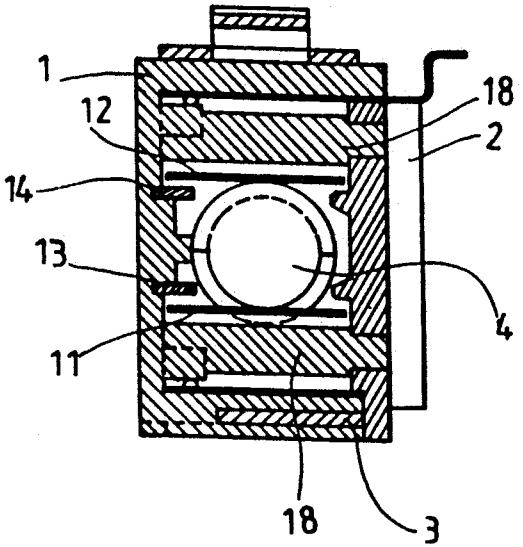
FIG. 3 is a cross section taken along line A—A of FIG. 2.
Figure 4:
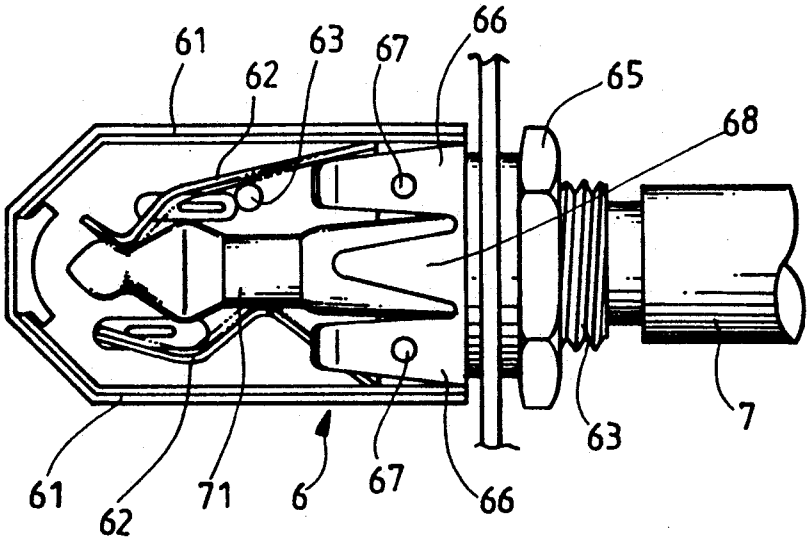
FIG. 4 is a perspective view of an auditory jack according to the prior art.

Referring to FIGS. 2 and 3, threading the audio signal input plug 4 of an audio output device into the internally threaded metal socket 15 causes the outer connecting end 41 of the audio signal input plug 4 to be inserted into the gap (not shown) between the first movable terminal 11 and the second movable terminal 12. As the outer connecting end 41 of the audio signal input plug 4 was inserted in between the first movable terminal 11 and the second movable terminal 12, the wing portion 112 of the first movable terminal 11 and the wing portion 122 of the second movable terminal 12 are respectively disconnected from the contact strip 132 of the first fixed terminal 13 and the contact strip 142 of the second fixed terminal 14. Because the wing portion 112 or 122 is formed on the respective triangular strip, which is springy, it is able to return to its original position after being pressed. Therefore, the wing portions 112,122 are still firmly maintained in contact with the outer connecting end 41 of the audio signal input plug 4 as they were squeezed by the outer connecting end 41. Because the casing 1 is protected inside the metal shell 3, the interference of outside electromagnetic waves is eliminated. Therefore, the auditory jack provides a satisfactory transmission quality.

What is claimed is:

1. An auditory jack comprised of a casing, a cover, a first movable terminal, a second movable terminal, a first fixed terminal, a second fixed terminal, an internally threaded metal socket, and a metal shell, wherein said internally threaded metal socket is fastened to said casing on the outside at one end; said casing has an internal space divided into a plurality of troughs by a plurality of projecting blocks into which said first movable terminal, said second movable terminal, said first fixed terminal and said second fixed terminal are respectively inserted, and a plurality of columns respectively made inside each trough and fitted into a respective round hole on said cover for permitting said cover to be firmly covered on said casing; said first movable terminal, said first fixed terminal, said second fixed terminal and said second movable terminal each has one end formed into a respective angle strip respectively and properly inserted into a row of grooves on a peripheral side edge of said cover and firmly retained in place by being squeezed by said cover against an inside wall of said casing; said metal shell receives said casing on the inside, and has an opening on one side wall thereof through which said metal socket projects out of said metal shell.

2. The auditory jack of claim 1 wherein said first movable terminal and said second movable terminal each has an opposite end respectively bent inward and formed into a respective triangular strip, which has a wing portion bilaterally and horizontally extended outward, the wing portion of either movable terminal being respectively and electrically connected to a respective contact strip on either fixed terminal; the angle strip of said first movable terminal and the angle strip of said second movable terminal are respectively extended out of said cover through the respective grooves.

* * * * *